US006169810B1

(12) United States Patent
van Halteren et al.

(10) Patent No.: US 6,169,810 B1
(45) Date of Patent: Jan. 2, 2001

(54) ELECTROACOUSTIC TRANSDUCER

(75) Inventors: A. Z. van Halteren, Hobrede; E. Wilmink, Delft; M. de Blok; O. Geschiere, both of Amsterdam; J. M. van Doorn, Alkmaar, all of (NL)

(73) Assignee: Microtronic Nederland, B.V.(NL)

( * ) Notice: Under 35 U.S.C. 154(b), the term of this patent shall be extended for 0 days.

(21) Appl. No.: 08/839,764

(22) Filed: Apr. 15, 1997

(30) Foreign Application Priority Data

Apr. 16, 1996 (NL) ..... 1002880

(51) Int. Cl.[7] ..... H04R 25/00

(52) U.S. Cl. ..... 381/174; 381/113; 381/191; 367/170

(58) Field of Search ..... 381/174, 191, 381/113, 116; 29/25.41, 594; 367/170, 181, 173, 188; 307/400

(56) References Cited

U.S. PATENT DOCUMENTS 4,730,283 * 3/1988 Carlson et al. ..... 381/191
5,255,246 * 10/1993 Van Halteren ..... 381/191

* cited by examiner

*Primary Examiner*—Huyen Le
(74) *Attorney, Agent, or Firm*—Michaelson & Wallace; Peter L. Michaelson

(57) ABSTRACT

An electroacoustic transducer of the electret type, having a backplate situated above a diaphragm, with the backplate being provided with spacers. The diaphragm is clamped on a frame-shaped carrier located at an underside of the diaphragm. The carrier is provided with supporting portions which are vertically aligned with the spacers. In one embodiment, supporting posts are formed on the supporting portions to allow the carrier to rest on a case bottom. The resulting electroacoustic transducer can be easily assembled with a reduced risk of damage.

28 Claims, 8 Drawing Sheets

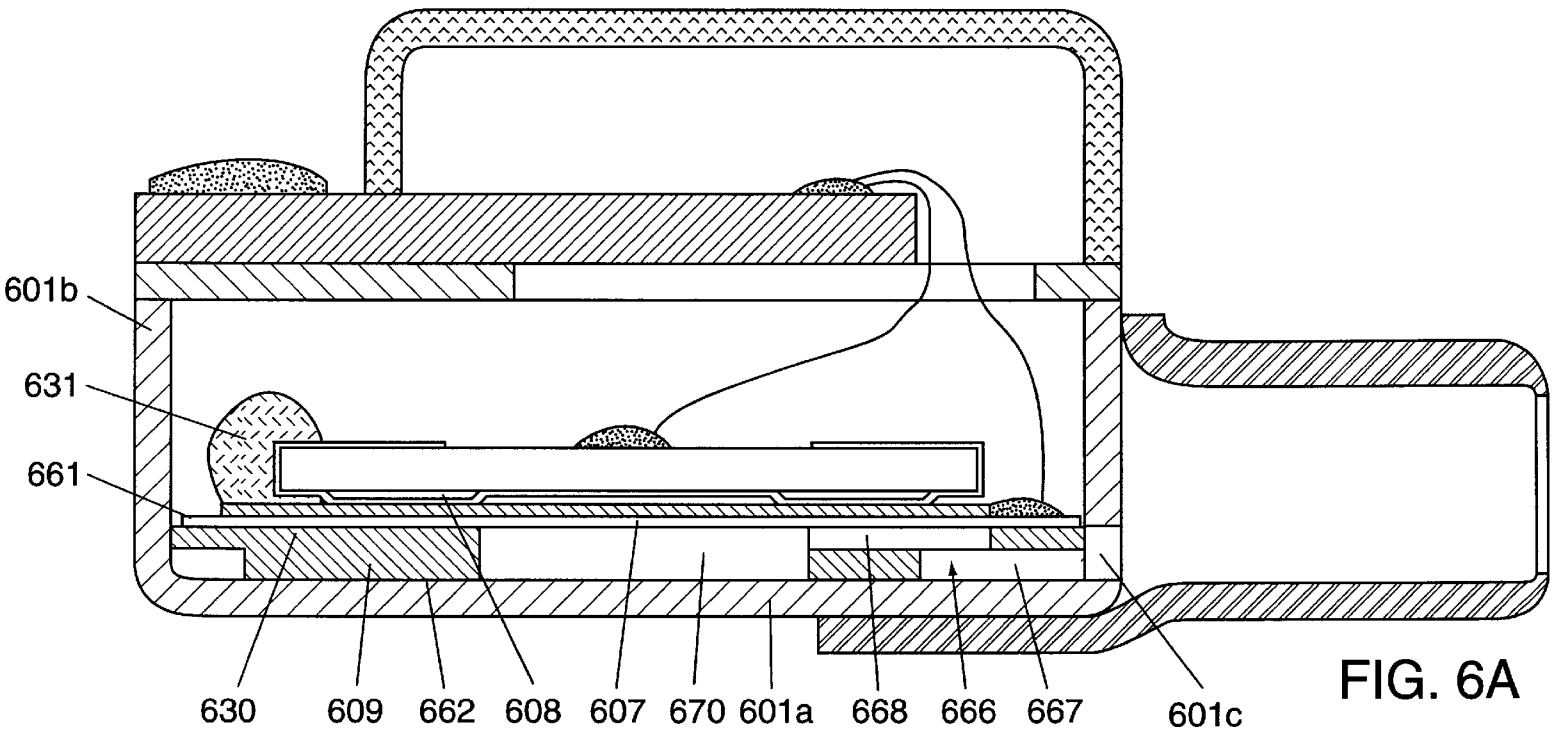
FIG. 6A
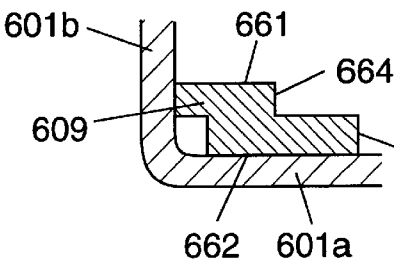
FIG. 6C
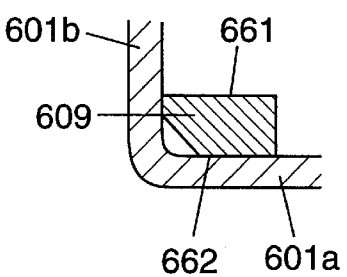
FIG. 6D
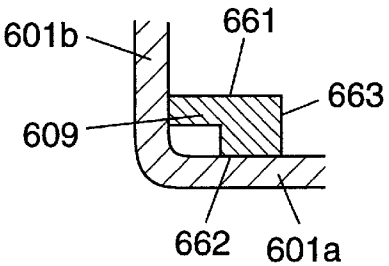
FIG. 6E
FIG. 6F

ELECTROACOUSTIC TRANSDUCER

This invention relates to an electroacoustic transducer having a substantially closed case with an internal microphone, wherein the microphone has a diaphragm, clamped on a carrier and provided with a conducting layer, and a backplate arranged parallel to the diaphragm. Such a transducer is known, for example, from published European patent application 0,533,284.

In general, the operation of such a transducer is based on the phenomenon that the capacitance of a capacitor is dependent on the mutual distance between its capacitor plates. If as a result of, for instance, acoustic vibrations, one of those plates is caused to vibrate so that the effective distance between the plates varies, the capacitance which varies as a result of this can be detected as an electrical signal. A widely applied embodiment of an electroacoustic transducer is of the so-called electret type where one of the capacitor plates is provided with a predetermined amount of charge. The 0 533 284 European patent application describes an example of such an electroacoustic transducer of the electret type, and in the following the present invention will be explained specifically for such an electroacoustic transducer of the electret type, but it is expressly noted that the invention is not limited thereto.

In general, such a transducer comprises a substantially closed case which is provided with an opening through which the interior of the case can communicate with the surroundings. Arranged in the case is a microphone capsule which, in the above-mentioned case of an electret type, is designated as electret system, which comprises a so-called backplate and a diaphragm arranged adjacent the backplate, which diaphragm is at least partly provided with a conducting layer. The electret system further comprises an electret layer which can be applied to the backplate or to the diaphragm; the diaphragm can even be manufactured from electret material. In the embodiment known from the publication mentioned, the electret layer is applied to the backplate.

Upon entry of sound waves into the case, the diaphragm is caused to vibrate, so that through the combination of the diaphragm and the backplate an electrical signal is generated which is representative of the sound waves, and which can be presented to an amplifier for further processing.

The object of the present invention is to improve the known transducer.

A first aspect of the present invention concerns the assembly of the backplate and the diaphragm in the case. Usually, the diaphragm is clamped on a frame-shaped carrier. The frame-shaped carrier has a substantially rectangular shape with rounded corners, the outer contour of the carrier corresponding to the inner contour of the case. The carrier with the diaphragm is arranged adjacent the bottom of the case, and above it the backplate is arranged. With a view to reducing parasitic capacitance between the backplate and the carrier, the carrier is located at the underside of the diaphragm, that is, on the side of the diaphragm remote from the backplate (see, for instance, as shown in FIG. 8 of EP-0,533,284). The distance between the diaphragm and the backplate is determined by distance elements or projections formed on the backplate; the constructional rigidity of the electret system with respect to the case is ensured by supporting means which support the diaphragm at the location of the distance elements mentioned. In the known device those supporting means are formed as supporting posts extending upright from the bottom of the case. For that matter, the diaphragm and the backplate are individually secured to the case.

In the conventional transducer, the height dimension of the carrier (also referred to as thickness) is less than the height dimension of the supporting posts, because otherwise it would be impossible for the diaphragm to be supported by the supporting posts. In the assembly of such a construction, a risk exists that when the carrier (with the diaphragm) is being placed in the case, the carrier is not moved down far enough, in which case the supporting posts do not support the diaphragm, or that the carrier is moved down too far, in which case the supporting posts deform the diaphragm and adversely affect the state of tension in the diaphragm. The subsequent placement of the backplate is also a precision job: if the backplate is mounted too high, the distance between backplate and diaphragm is too great and hence the sensitivity of the transducer too low. In this connection, it is a drawback that the positioning of the backplate relative to the diaphragm only occurs when the backplate is being fitted in the case.

The object of the invention is to overcome the disadvantages mentioned.

According to an important aspect of the present invention, the supporting means for the diaphragm are formed on the diaphragm carrier. Thus the carrier no longer functions solely for clamping and retaining the diaphragm along the edge thereof, but also for supporting the diaphragm at the location of at least some of the distance elements of the backplate. An important advantage of this is that the transducer, to work properly, is no longer dependent on supporting posts formed on the case. The case can even be constructed without supporting posts formed on the case, which is constructionally simpler and cheaper.

Another important advantage of the present invention is that the electret system, that is, the combination of carrier, diaphragm and backplate, prior to being placed in the case, can be formed as an electret unit, with the backplate being attached to the carrier, for instance by means of a suitable glue. Positioning the backplate relative to the diaphragm with great accuracy has then become relatively simple. Another advantage in this connection concerns the fact that the shape of the backplate can now be simpler, and that the backplate does not need to be secured to the inner wall of the case, which saves a processing step. In the conventional transducer as known from European patent application 0,533,284, the backplate has the shape of a rectangle whose dimensions are less than the corresponding internal dimensions of the case to allow air displacement, which rectangle, adjacent its corner points, is provided with projections for connecting the backplate mechanically and electrically with the case. In the transducer according to the present invention, the backplate can simply have the shape of a rectangle, and no separate operation is necessary to secure the backplate mechanically to the case.

Forming an electret unit (subassembly) consisting of the combination of carrier, diaphragm and backplate is known per se from U.S. Pat. No. 4,730,283. There, however, the carrier and the backplate are located on the same side of the diaphragm, with the backplate being placed within the carrier. The backplate is glued through its corner points to the carrier, with either the outside corners of the backplate or the inside corners of the carrier being provided with projections. The carrier thus does not serve for supporting the diaphragm at the location of the distance elements of the backplate. This entails as a disadvantage that the positioning of the backplate in the carrier is particularly cumbersome and should be done with particular accuracy: if the backplate is not pressed far enough into the carrier, the distance between backplate and diaphragm is too large and hence the sensitivity of the transducer is too low, whereas if the backplate is pressed too far into the carrier, the diaphragm can be deformed. Thus the problem of the cumbersome positioning of the carrier with the diaphragm in the case has shifted to the problem of the cumbersome positioning of the backplate in the carrier.

A second aspect of the present invention concerns the processing of the electrical signal. As has been described extensively in EP-0,533,284, the transducer is provided with an electric circuit for amplifying the electric signal generated by the electret system. Conventionally, one of the components of the electret system is connected with the amplifier circuit via a signal line for feeding the electric signal generated by the electret system to that amplifier circuit; the other component of the electret system is connected with the amplifier circuit via mass (i.e., the case). For instance, in the construction as described in EP-0,533,284, the electrically conductive surface of the diaphragm is connected with the amplifier circuit via a signal line, while the backplate is connected with mass. In the construction as described in U.S. Pat. No. 4,730,283 the backplate is connected with the amplifier circuit via a signal line, while the diaphragm is connected with mass.

According to the second aspect of the present invention, both the backplate and the diaphragm are electrically floating with respect to mass. The backplate is connected via a first signal line to a first signal input terminal of the amplifier circuit, while the diaphragm is connected via a second signal line to a second signal input terminal of the amplifier circuit. The amplifier circuit comprises, at its input, a differential amplifier with two inputs which are respectively coupled with the signal input terminals mentioned. This makes it possible to suppress common-mode signals, and hence achieve a reduced noise level.

These measures can be applied with particular advantage in the transducer according to the first aspect because there the backplate does not need to be connected to the case.

A third aspect of the present invention concerns the attachment of the carrier to the case. Conventionally, the diaphragm carrier is attached along its outer circumference, for instance through glueing, to the upright walls of the case. This is cumbersome and should be done with great accuracy because any vertical mis-positioning of the diaphragm carrier has adverse consequences for the state of tension in the diaphragm. According to the third aspect of the present invention, the carrier is supported on the bottom of the case. The bottom can be provided with supporting posts, similar to the supporting posts of the conventional transducer, which supporting posts, however, now support the carrier rather than the diaphragm. Advantageously, such supporting posts are located under said supporting members of the carrier. It is also possible, however, that the carrier is supported on the bottom throughout its circumference. In that case the carrier preferably has a stepped cross section, with the lower portion of the carrier having a smaller outer dimension than the upper portion, to thus allow for the somewhat rounded configuration of the inside angle between the bottom of the case and the upright walls thereof. A further advantage of such a construction is that it is possible to vary the relative positioning of the lower portion relative to the upper portion (freedom of design) at the location of the air inlet to the interior of the case, for varying acoustic characteristics of the transducer in a desired manner. More particularly, in this way the damping of the air inlet can be varied. In conventional transducers for hearing aids, for that purpose a gauze is arranged in the air inlet, which, however, requires a separate operation and hence is relatively expensive, while in practice gauze can become clogged, for instance as a result of ear wax, and, as a result, can eventually have an adverse effect on, or even block, the operation of the microphone.

The above-mentioned and other aspects, features and advantages of the present invention will be clarified through the description below of a preferred embodiment of an electroacoustic transducer according to the invention, with reference to the drawing, in which:

FIG. 1 diagrammatically shows a cross section of a known electroacoustic transducer for the purpose of illustrating the general construction and operation thereof;

FIG. 2 diagrammatically shows a partly cutaway perspective view of the electroacoustic transducer shown in FIG. 1;

Figure 3A:
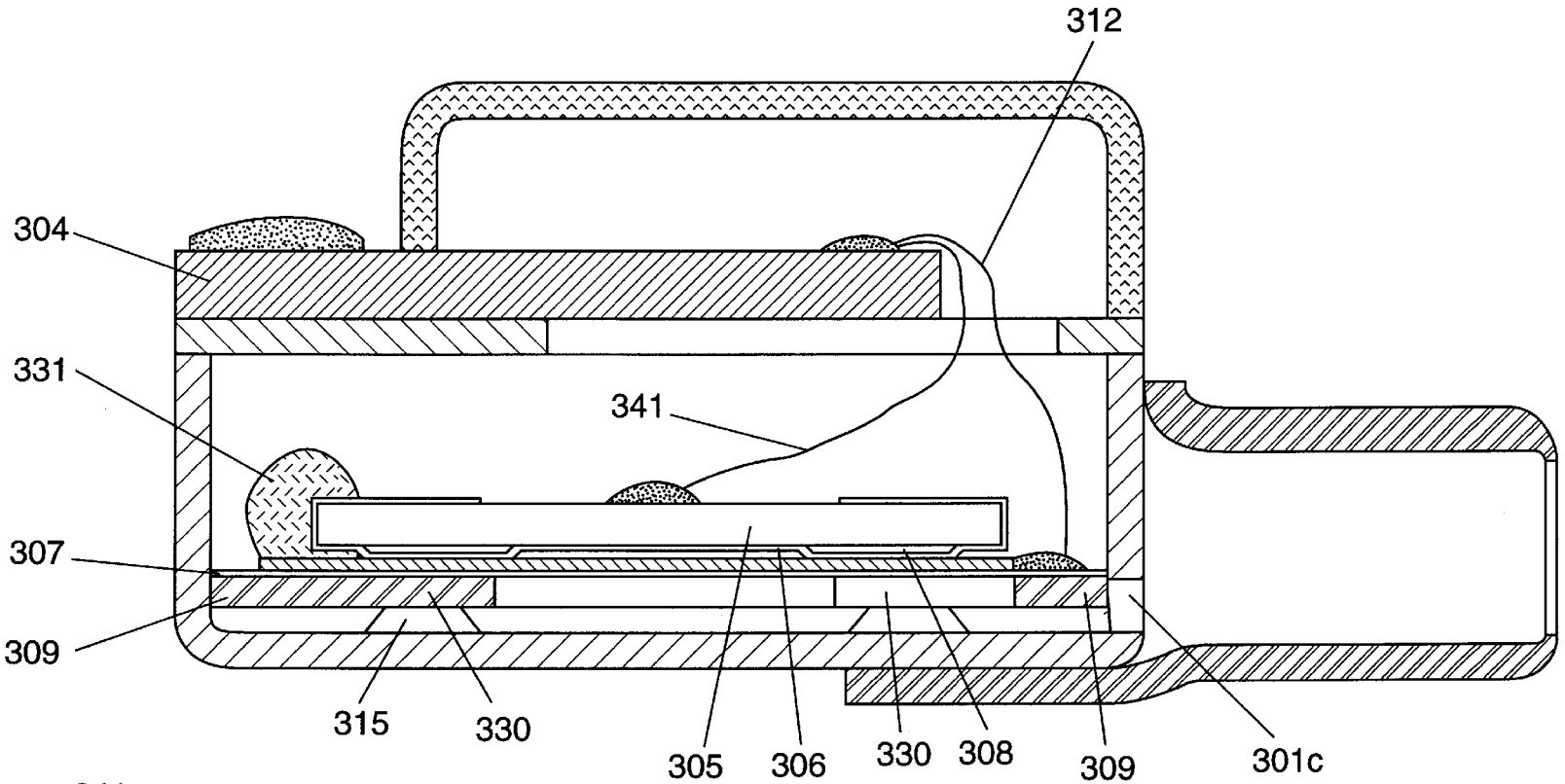
FIG. 3A shows a cross section similar to FIG. 1 of an electroacoustic transducer according to the invention.
Figure 4:
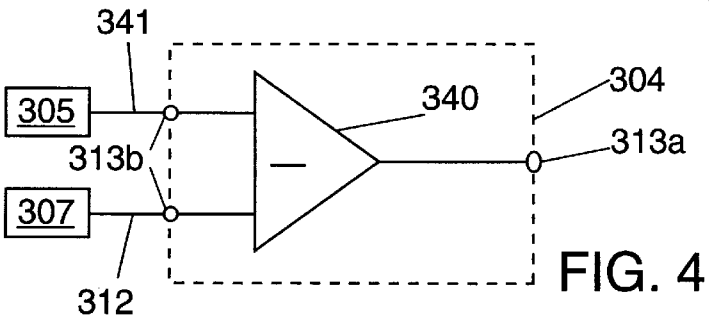
Figure 3B:
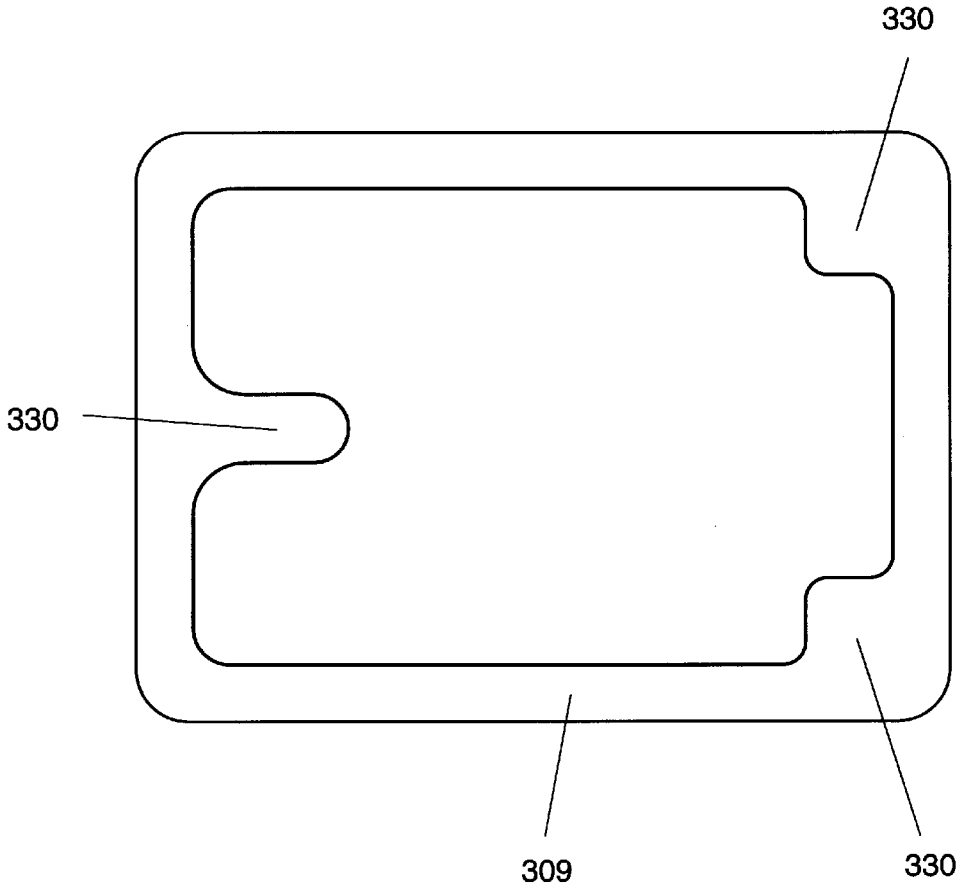
FIG. 3B shows a top plan view of an exemplary embodiment of a carrier according to the present invention.
Figure 3C:
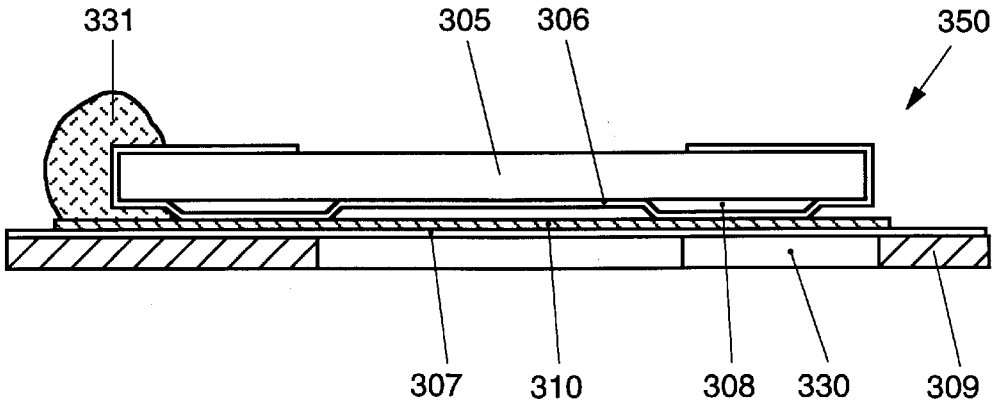
FIG. 3C shows a schematic cross section of an exemplary embodiment of an electret unit according to the present invention.
Figure 5A:
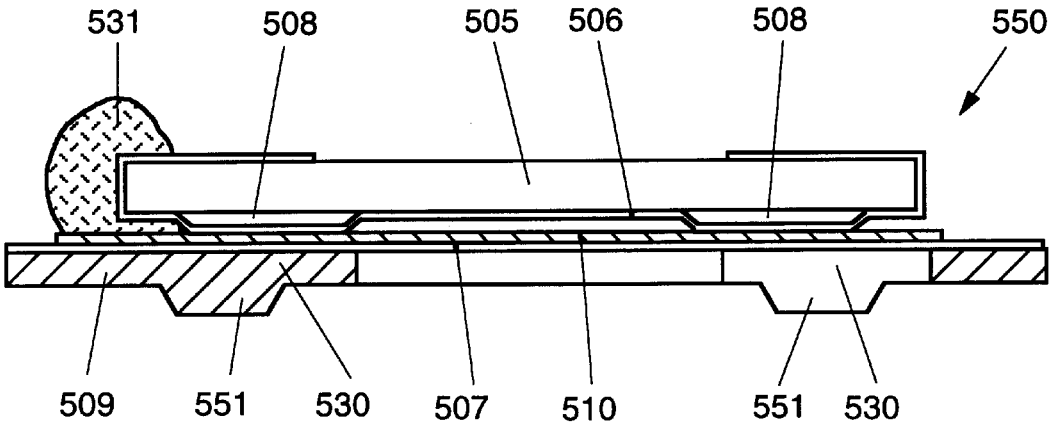
Figure 5B:
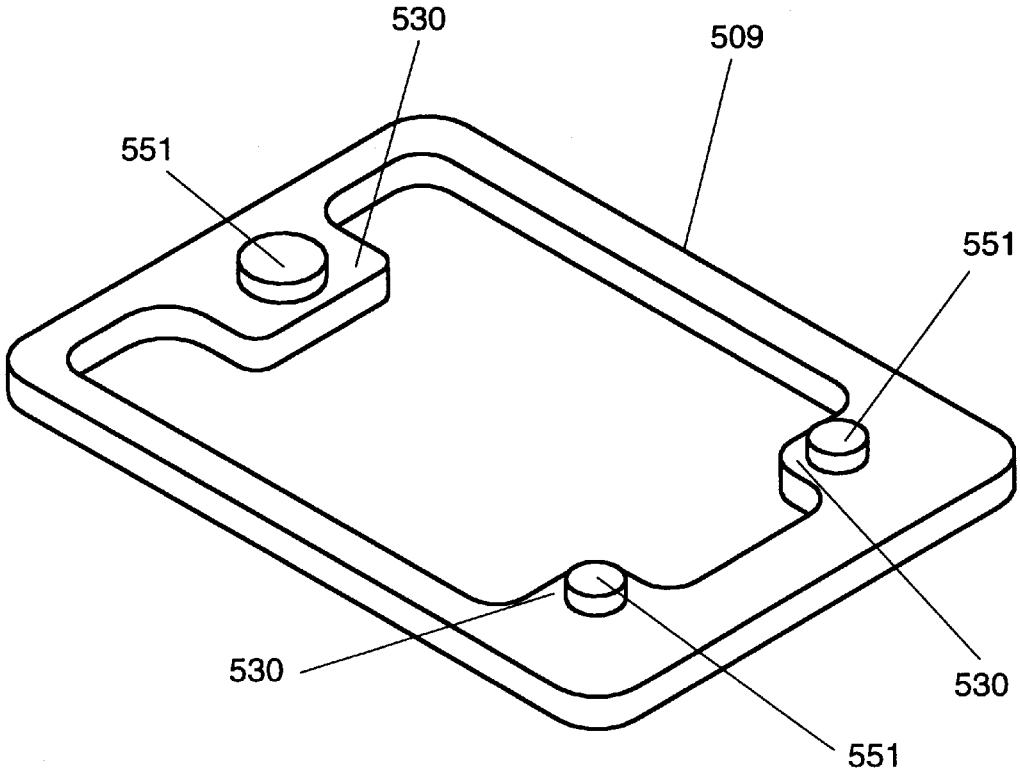
Figure 6B:
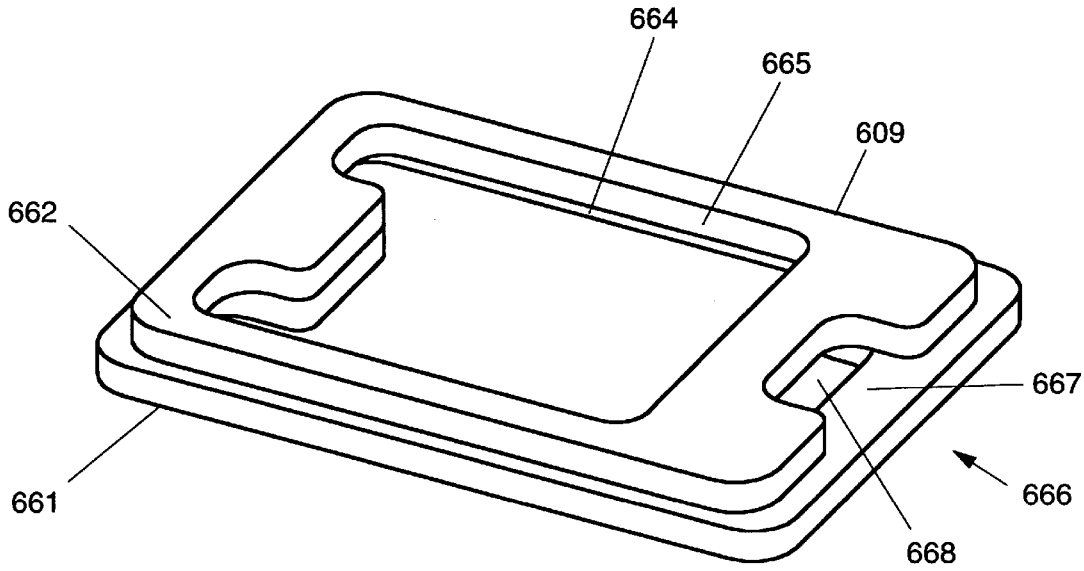
Figure 6G:
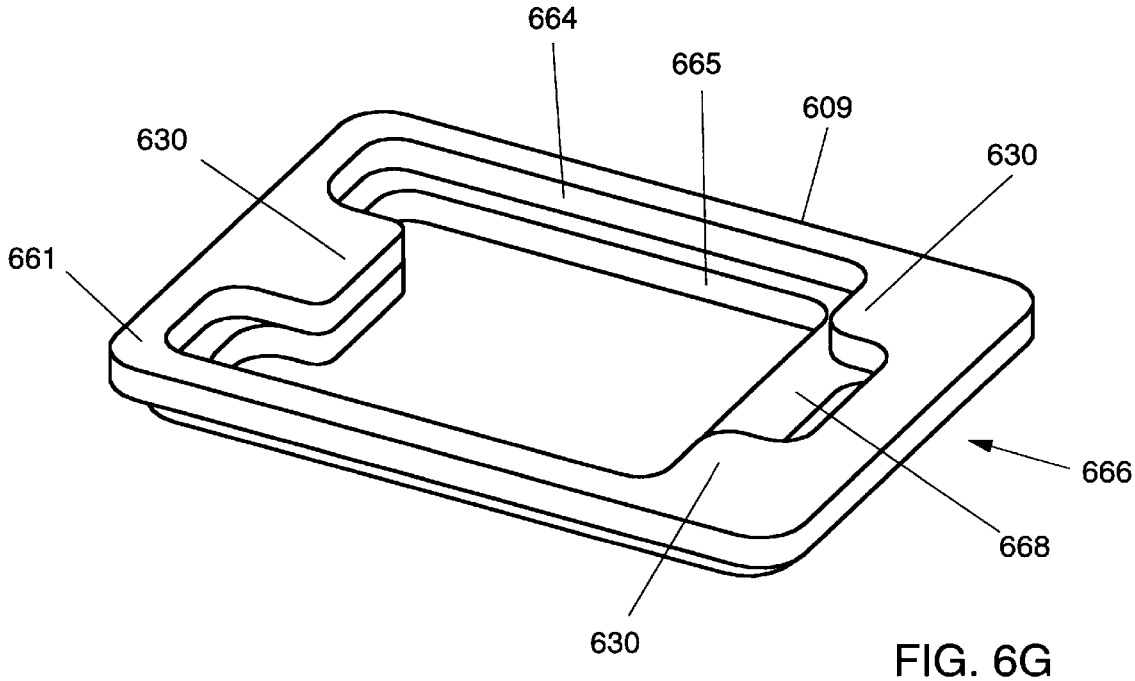
Figure 7:
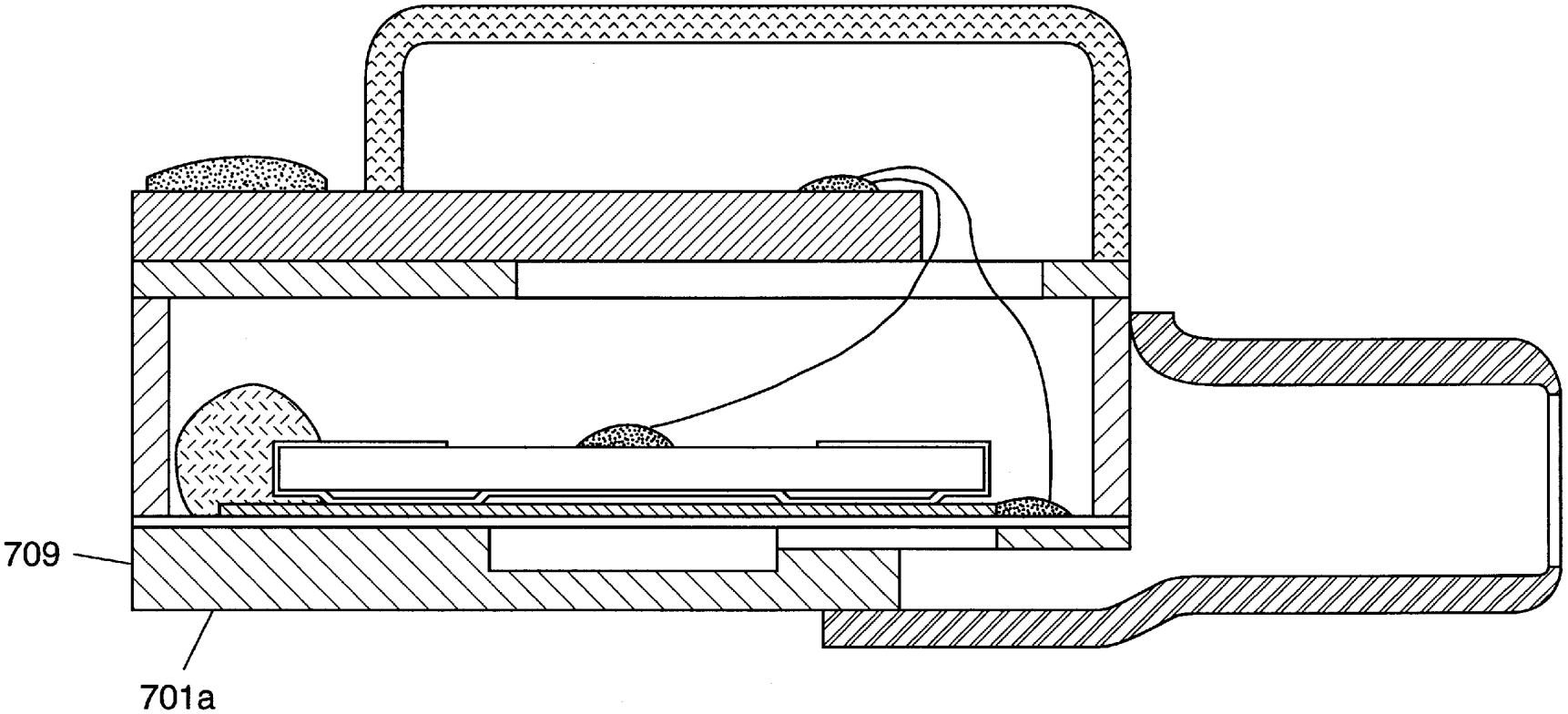

FIG. 4 diagrammatically shows a circuit diagram of an amplifier circuit built into an electroacoustic transducer according to the invention;

FIG. 5A shows a cross section similar to FIG. 3C of another exemplary embodiment of an electret unit according to the present invention;

FIG. 5B shows in perspective a bottom view of a carrier which can be used in the exemplary embodiment of an electret unit according to the present invention illustrated in FIG. 5A;

FIG. 6A shows a diagrammatic cross section of a variant embodiment of the electroacoustic transducer according to the present invention;

FIG. 6B shows in perspective a bottom view of a carrier which can be used in the exemplary embodiment of an electroacoustic transducer according to the present invention illustrated in FIG. 6A;

FIGS. 6C–F show detail variants of the carrier of FIG. 6B;

FIG. 6G shows in perspective a top plan view of the carrier of FIG. 6B; and FIG. 7 shows a diagrammatic cross section of another variant embodiment of the electroacoustic transducer according to the present invention.

Figure 1:
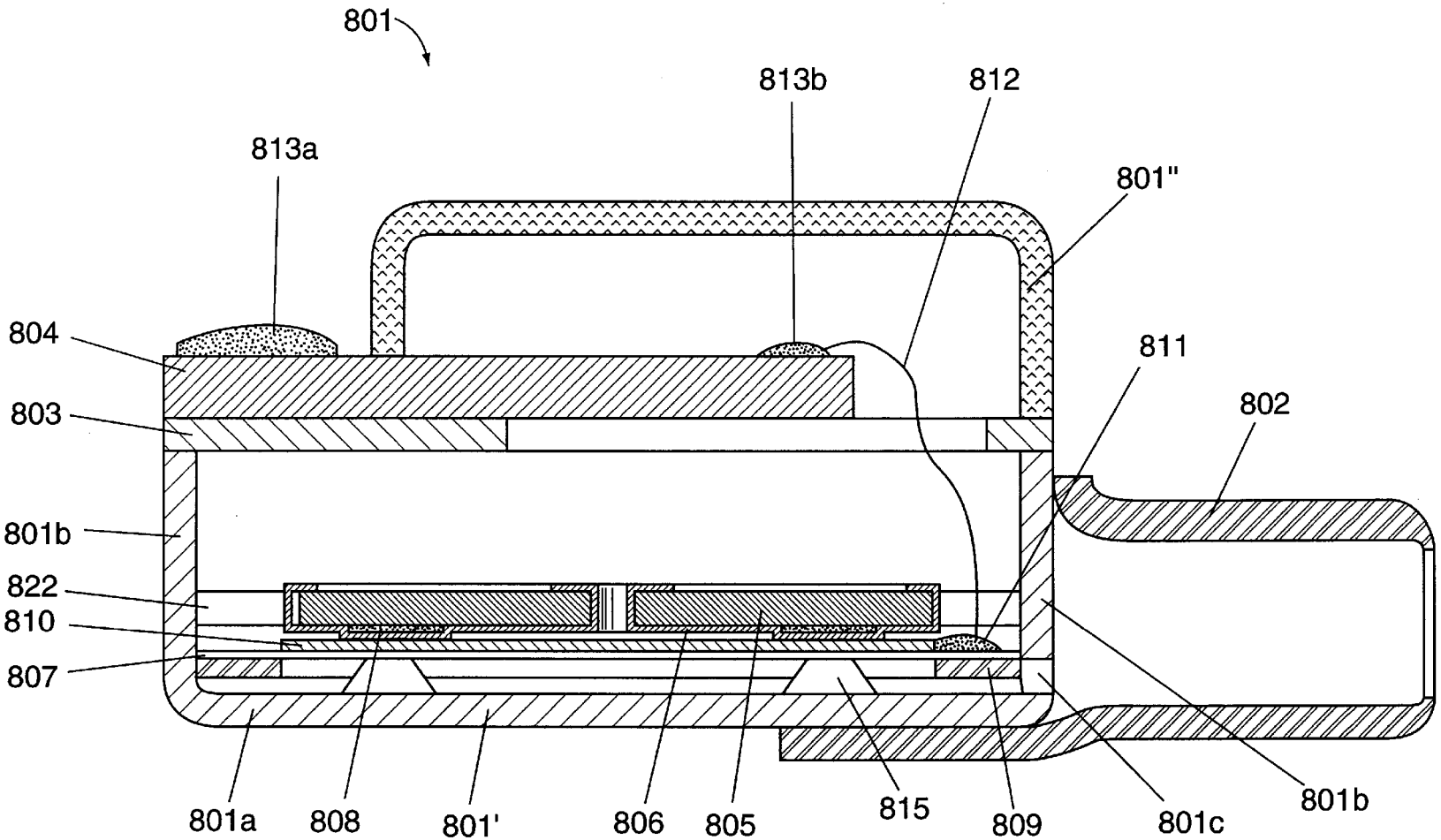
FIG. 1 (PRIOR ART)
Figure 2:
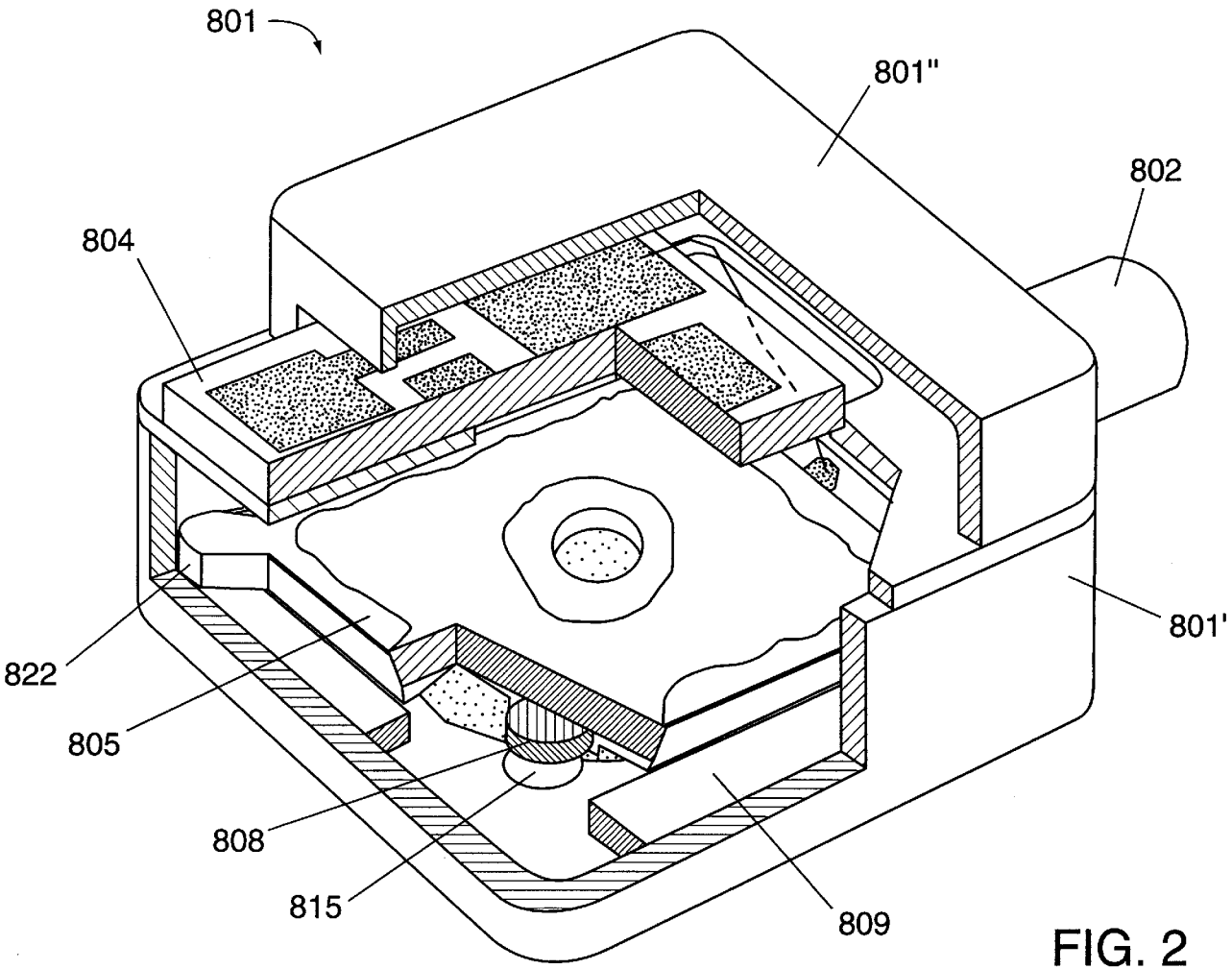
FIG. 2 (PRIOR ART)

Presently, with reference to FIGS. 1 and 2, the general construction and operation of an electroacoustic transducer of the electret type will be briefly discussed. These FIGS. 1 and 2 are substantially identical to FIGS. 8 and 9 of European patent application 0,533,284, to which publication reference is made for a more detailed discussion. The content of that publication is considered to be incorporated into the present application by reference.

An electroacoustic transducer comprises a case 801 consisting of a lower case portion 801' and an upper case portion or cover 801". The lower case portion 801' generally has the shape of a rectangular vessel with a bottom 801*a* and upright sidewalls 801*b*. In one of the sidewalls 801*b*, adjacent the bottom 801*a*, an opening 801*c* is provided, through which the interior of the case 801 can communicate with the surroundings. Connected to the case 801 is a spout 802, in which a damping screen (not shown in FIG. 1) can be arranged. To the spout, for instance an air hose can be attached, but the spout can also serve for connecting the microphone itself and/or for adjusting the characteristic of the microphone. The damping screen generally consists of a gauze, and serves to damp resonance peaks in the frequency characteristic; a desired frequency response can be obtained by choosing a particular density of the gauze.

Located between the lower case portion 801' and the cover 801" is a mounting plate 803, which is provided with an opening located within the case 801, for passing through electric connecting wires 812. Arranged on the mounting plate 803 is an electric circuit 804, for instance a buffer circuit or an amplifier circuit, constructed in thick-film technique, which circuit 804 is located partly inside and partly outside the case 801. The part of the circuit 804 located outside the case 801 comprises electrical terminals 813*a* for connecting the circuit 804 with external electrical equipment. The part of the circuit 804 located within the case 801 comprises electrical input terminals 813*b* for connection to the electrical connecting wires 812 mentioned.

Arranged in the case 801 is a diaphragm 807, substantially parallel to the bottom 801*a*. The diaphragm is made of a material that is suitable inter alia as to stiffness and thickness. In the example shown, the diaphragm is made of an electrically insulating material, such as for instance Mylar (polyethylene terephthalate), as known per se, and the diaphragm 807 has an active portion covered with an electrically conductive layer 810, for instance of gold, which can have been applied to the diaphragm 807, for instance, through evaporation. The diaphragm 807 can also be made of an electrically conductive material.

The diaphragm 807 divides the internal volume of the case 801 in two parts, the part in communication with the air inlet opening 801*c* being designated as pre-volume. The diaphragm 807 is clamped at its circumferential edge onto a frame-shaped carrier 809, which is connected to the inner wall of the upright case walls 801*b*. The carrier 809 is disposed in the pre-volume mentioned, that is, at the underside of the diaphragm 807. The conductive layer 810 is located on the side of the diaphragm 807 remote from the carrier 809, that is, at the upper side of the diaphragm 807, and is connected via an electrically conductive contact material 811, for instance silver epoxy, to an end of an electrical connecting wire 812, of which the other end is connected to an input terminal 813*b* of the circuit 804.

Further arranged within the case 801 is the so-called backplate 805. The backplate 805 has a substantially rectangular shape, corresponding to the shape of the case 801, but has smaller dimensions, so that the circumferential edge of the backplate 805 is spaced from the upright case walls 801*b*. The backplate 805 is manufactured from an electrically conductive material, such as for instance stainless steel, or of a material provided with an electrically conductive layer, for instance ceramics with a layer of gold. The backplate 805 is arranged parallel to the diaphragm 807, at a short distance therefrom, viz. on the side of the diaphragm 807 remote from the carrier 809, that is, at the upper side of the diaphragm 807. The surface of the backplate 805 proximal to the diaphragm 807 is covered with an electret material 806, such as for instance Teflon (tetrafluoroethene-perfluoropropene), as known per se. On the electret material 806 a predetermined amount of electrical charge is provided.

The backplate 805 is also electrically connected to the circuit 804. In the transducer known from EP-0,533,284 that electrical connection proceeds via the electrically conductive case 801, to which end the backplate 805 is connected via electrically conductive ribs 822 with the upright case walls 801*b*.

The operation of the electroacoustic transducer is, briefly summarized, as follows. Sound vibrations reaching the interior of the case 801 via the opening 802 cause a vibration of the diaphragm 807. As a consequence, a change is generated in the capacitance as defined between the diaphragm 807 and the backplate 805, so that the voltage across the diaphragm 807 and the backplate 805 as caused by the predetermined charge mentioned, changes too. This voltage change, which is representative of the sound vibrations mentioned, is amplified by the circuit 804 for further processing.

For a proper operation of the electroacoustic transducer it is of importance that the distance between the surface of the conductive layer 810 of the diaphragm 807 and the surface of the electret layer 806 of the backplate 805 is small (for a good sensitivity), but the diaphragm 807 may not uncontrollably touch the backplate 805. Further, the distance referred to should be known exactly, and it should be predeterminable. To that end, at predetermined points, spacers are arranged between the backplate 805 and the diaphragm 807. Those spacers can be formed as projections at the underside of the backplate 805 itself, as known, for instance, from U.S. Pat. No. 4,730,283, but this is difficult to realize in an accurate and reproducible manner. Preferably, those spacers are formed by the arrangement of thin, plate-shaped members 808 on the backplate 805, whereafter the layer of electret material 806 is applied over the combination of the backplate 805 and those plate-shaped members 808. It is relatively simple to manufacture such plate-shaped members 808 with the desired accuracy. It is preferred that the plate-shaped members 808, for the purpose of reducing the parasitic capacitance, consist of an electrically insulating material, such as for instance Kapton (a composition of polyimide and tetrafluoroethene-perfluoropropene), as known per se. The provision of plate-shaped members can be simply carried out through heating, because then those members stick to the backplate.

Arranged on the bottom 801*a* of the case 801 are supporting posts 815, aligned with the plate-shaped members 808. The supporting posts 815 serve for defining a reference position of the diaphragm 807 with respect to the case 801. Further, the supporting posts 815 serve to fix the backplate 805 to thereby reduce the sensitivity to vibrations of the backplate.

In the following, the invention will be explained in more detail with reference to FIGS. 3–6, where construction details that can be equal to the details discussed in the foregoing will not be represented or will be represented only schematically. In the figures equal or similar parts will be designated by equal reference numerals, with the understanding that the 'hundred' in the reference numerals corresponds to the number of the figure in question.

FIGS. 3A–C illustrate the first aspect of the present invention. The frame-shaped carrier 309 is provided with inwardly directed protrusions 330 (see in particular FIG. 3B). At least some of the protrusions 330 function as carrying members for the diaphragm 307 and to that end are aligned with the spacers 308 of the backplate 305. Further, at least some of the protrusions 330 serve to allow the carrier 309 to rest on the bottom 301*a*, through the intermediacy of the supporting posts 315, to which end those protrusions 330 are aligned with the supporting posts 315. In order to allow the active surface of the diaphragm 307 to be as large as possible, and in order to prevent any deformations of the carrier as a result of undue vertical force of the backplate, the first and second protrusions 330 are preferably identical, that is to say that the supporting posts 315 are aligned with the spacers 308. Similar to the conventional backplate, a surface of backplate 305, proximate to diaphragm 307, is covered with conventional electret material 306. The construction of the diaphragm 307 can be identical to the construction of the conventional diaphragm, and will not be further discussed. Further, the construction of the backplate 305 can be identical to the construction of the conventional backplate, which will not be discussed further, with the exception of the mechanical and electrical connection of the backplate 305.

An important advantage of the electroacoustic transducer according to the present invention illustrated in FIG. 3 is that during assembly the diaphragm 307 no longer comes into contact with the supporting posts 315, but that the carrier 309 comes to rest on the supporting posts 315, so that the chance of mispositioning of the diaphragm 307 is reduced, as is the chance of damage of the diaphragm 307 by the supporting posts 315. Another important advantage of the electroacoustic transducer according to the present invention illustrated in FIG. 3 is that during assembly the spacers 308 of the backplate 305 touch the diaphragm 307 at a position where the diaphragm 307 is supported by the supporting members defined by the protrusions 330 of the carrier 309, so that the chance of damage to the diaphragm 307 caused by the backplate 305 is reduced.

The backplate 305 can be connected to mass (case) via a separate electrical conductor, as in the conventional device. Preferably, however, the backplate 305 is not connected to the case at all, mechanically nor electrically, and the electrical connection of the backplate 305 to the amplifier circuit 304 occurs via a separate electric conductor 341. The amplifier 304 thus receives a signal coming from the backplate 305 and a signal coming from the diaphragm 307, which provides the possibility of eliminating the common-mode signals by presenting these signals to the inputs of a differential amplifier 340, as illustrated in FIG. 4.

As mentioned, it is possible, according to the present invention, that the backplate 305 is no longer connected to the case 301 in electrical as well as mechanical respect. In an advantageous embodiment, the backplate 305 is attached to the carrier 309, for instance through glue, as schematically indicated in FIG. 3A with 331. The glue 331 can extend along the entire circumferential edge of the backplate 305, or can be provided only at certain circumferential portions of the backplate 305.

In the foregoing it has been described that the assembly of the transducer has been simplified, at least entails less chance of damage to the diaphragm 307. According to a further aspect of the present invention, the assembly of the transducer is further simplified because a separate electret unit 350 (FIG. 3C) can be provided, consisting of the combination of carrier 309, diaphragm 307 and backplate 305, with the backplate 305 being attached to the carrier 309 through glue 331, which unit 350 can be assembled outside the case 301 and can later be placed in the case 301 as one whole. Fitting the backplate 305 on the carrier/diaphragm-combination 309, 307 (outside the case 301) has thereby been simplified, and can be carried out without the risk of damage to the diaphragm 307 due to the spacers 308 because the diaphragm 307 is supported at the location of those spacers 308 by the supporting members (protrusions 330) of the carrier 309.

Fitting that electret unit 350 in the case 301 is also particularly simple and can be carried out without the risk of damage to the diaphragm 307 due to the supporting posts 315, because the supporting posts 315 can no longer touch the diaphragm 307. Further, it is now possible in a simple manner to accurately position the electret unit 350 in the case 301 with a substantially reduced chance of mispositioning, because the carrier 309 of the electret unit 310 eventually rests on the supporting posts 315 and, if desired, may even be pressed down to some extent.

In the foregoing it has been discussed that the carrier 309 rests on supporting posts 315 which are formed on the bottom 301*a* of the case 301. However, forming supporting posts on the bottom of the case is relatively cumbersome and therefore relatively expensive.

According to a further aspect of the present invention this problem is solved by forming the supporting posts, preferably integrally, on the carrier. Forming supporting posts on the carrier is simpler and hence cheaper than forming supporting posts on the bottom of the case. This aspect of the present invention is illustrated in FIG. 5A, in which an electret unit 550 is shown which is identical to the electret unit 350 shown in FIG. 3C, except that at the underside of the carrier 509, that is, the side of the carrier 509 remote from the diaphragm 507 and the backplate 505, supporting posts 551 are formed, preferably, and as shown, aligned with the spacers 508 of the backplate 505. FIG. 5B shows a perspective bottom plan view of the carrier 509. It is noted that although the supporting posts 551 are represented schematically as being cylindrical, they can, in principle, have any suitable shape.

The electret unit 550 illustrated in FIG. 5A can be fitted in a case 501 with a flat bottom 501*a* (not separately illustrated for simplicity), the combination of such a case 501 with such an electret unit 550 behaving in substantially the same way as the combination of the earlier described case 301 with the electret unit 350.

In the exemplary embodiments of the electroacoustic transducer according to the present invention discussed in the foregoing, the height of the diaphragm, that is, the mutual distance between the diaphragm and the bottom of the case, is defined by the sum of the vertical thickness of the carrier and the vertical dimension of the supporting posts. In a variant, the height of the diaphragm is defined solely by the vertical thickness of the carrier, with the carrier being supported directly on the bottom of the case. This variant is illustrated in FIGS. 6A–F, FIG. 6A being similar to FIG. 3A, and FIG. 6B being similar to FIG. 5B. FIGS. 6C–F show details of the shape of the carrier in cross section. Starting from the embodiment illustrated in FIGS. 5A–B, the variant of FIGS. 6A–F can be seen as the replacement of the individual supporting posts 551 (three in number in the embodiments illustrated in FIGS. 5A–B) with a single supporting ring under the carrier, or as the omission of the individual supporting posts 551 but with the carrier as a whole made of thicker design.

In the following discussion of the embodiment illustrated in FIGS. 6A–G, the entire construction carrying the diaphragm 607 will be designated as carrier 609. At its top surface 661, that is, the main surface proximal to the diaphragm 607, the carrier 609 has a shape that can be identical to the shape of the earlier discussed carrier 509, that is, the shape of a rectangular ring with rounded outside corners, in accordance with the inner contour of the case 601, so that the carrier 609 at its top surface 661 adjoins the inside of the upright case walls 601*b*. At its undersurface 662, that is, the main surface being in contact with the flat bottom 601*a* of the case, the outer dimensions of the carrier 609 are less than the outer dimensions adjacent the top surface 661, to ensure that the generally annular carrier 609 can rest by its undersurface 662 on the case bottom 601*a* without experiencing any hindrance from any inner radius of the case 601 at the transition from the bottom 601*a* to the wall 601*b*. To that end, the carrier 609, at the outer edge of its undersurface 662, can for instance be rounded or bevelled, or stepped, as illustrated in FIGS. 6C–6E, respectively.

At its inner edge 663 the annular carrier 609 can have equal dimensions at its top surface 661 and undersurface 662. FIG. 6F shows a detail, similar to FIG. 6E, of a carrier 609 whose inner edge 663 is stepped from an upper inner edge 664 to a lower inner edge 665, the lower inner edge 665 having smaller dimensions than the upper inner edge 664. The inner edge 663 can also have a configuration gradually changing from a relatively small dimension adjacent the undersurface 662 to a relatively large dimension adjacent the top surface 661, for instance defining an inclined surface. Thus, the advantage of a largest possible free diaphragm surface is combined with the advantage of a largest possible supporting surface at the bottom of the case.

With a thus formed carrier 609 the undersurface 662 lies on the bottom 601*a* of the case 601 along a closed ring, that is, the annular carrier 609 rests on the case bottom 601*a* throughout its circumference and thus defines, under the diaphragm 607, a space 670 enclosed by the carrier 609. Acoustic vibrations passing the sound inlet gate 601*c* must, before they can reach the space 670, pass the carrier 609, to which end the carrier 609 is provided with a passage 666 communicating with the sound inlet gate 601*c*. To that end, the carrier 609 can be provided with a substantially horizontally extending channel, for instance in the form of a slot 667 formed starting from the undersurface 662. It is also possible that such a slot 667 extends only over a part of the width of the carrier 609, and that the carrier 609 is further provided with a slot 668 formed starting from the top surface 661, likewise extending only over a part of the width of the carrier 609, with the lower slot 667 terminating at the outer edge of the carrier 609, and the upper slot 668 terminating at the inner edge of the carrier 609, the two slots 667 and 668 meeting at a central portion of the body of the carrier 609.

An important advantage of such a passage 666 formed in the carrier 609 is that the passage 666 can be designed in different ways, whereby the dimensions and the shape of the passage 666 can be varied to thereby vary the acoustic properties of the transducer.

A transducer with a construction as has been described in the foregoing has as an advantage, among others, that the dimensions of the backplate are not limited by the inner contour of the carrier. There is some freedom in determining the precise outer dimensions of the backplate, so that the size of the space between the backplate and the case can be varied, allowing variation of the frequency characteristic of the microphone because resonance peaks can be damped to a lesser or to a greater extent: a smaller passage yields greater damping. Through an appropriate choice of the outer dimensions of the backplate, optionally in combination with the shape and size of the passage 666, damping material in the spout can be rendered redundant.

FIG. 7 illustrates another advantageous variant of the electroacoustic transducer according to the present invention, which, for that matter is similar to the embodiment illustrated in FIG. 6. In this variant the diaphragm carrier 709 is formed as an integral part of the bottom of the case 701. This provides the advantage, among others, that the number of parts is reduced, which yields a saving in material costs, manufacturing costs, assembly costs, and the like. Another advantage concerns the thickness of the diaphragm carrier: because the stiffness of the diaphragm carrier is now defined by the combination of diaphragm carrier and case bottom, the carrier portion proper of this combination part can be made of thinner design, so that eventually the thickness of the entire case can be smaller.

It will be clear to one skilled in the art that it is possible to alter or modify the embodiment of the device according to the invention as represented, without departing from the concept of the invention or the scope of protection. Thus, it is, for instance, possible that the circuit and/or the external terminals thereof are constructed in a different way and/or are attached to the case in a different way.

It is also possible that the carrier 309 is provided with several protrusions 330, with the protrusions functioning as supporting members for the diaphragm differing from the supporting members serving to support the carrier on the supporting posts 315.

Instead of an electret design, the transducer can also comprise a "common" capacitor microphone which is charged from a battery. Further, the shape of the case and/or of the terminals can be chosen differently.

In the embodiment discussed the number of supporting portions on the diaphragm carrier is the same as the number of spacers formed on the backplate. It is also possible, however, that there are more spacers than supporting portions, with the "excess" of spacers touching the diaphragm without a "counteraction" from a supporting portion. The obverse is also possible. For a stable effect within the framework of the present invention it is preferred that the number of combinations of mutually aligned spacers and supporting portions is at least equal to three.

In the embodiment discussed, the electret layer is always provided on the backplate. It is also possible, however, for the electret layer to be provided on the diaphragm. It is even possible to choose an electret material for the diaphragm itself.

What is claimed is:

1. An electroacoustic transducer comprising:

a substantially closed case provided with a sound inlet opening; and a microphone system, arranged in the case, which comprises:

a diaphragm clamped on a frame-shaped carrier, the diaphragm being at least partly provided with a conducting layer;

a backplate arranged adjacent and parallel to the diaphragm, the backplate being located on a side of the diaphragm remote from the carrier; and spacers arranged between the backplate and the diaphragm;

wherein the frame-shaped carrier is integrally provided with inwardly-extending supporting portions, oriented parallel to the diaphragm, which through an upper surface of the supporting portions solely supports the diaphragm, at least one of the supporting portions being located below and supporting at least one of the spacers.

2. The electroacoustic transducer according to claim 1 wherein the microphone system comprises an electret system, and an electret layer is provided on the backplate.

3. The electroacoustic transducer according to claim 1 wherein at least three of said supporting portions are located below the spacers, and each one of the supporting portions supports a corresponding different one of the spacers.

4. The electroacoustic transducer according to claim 1 wherein the carrier is supported on a bottom of the case.

5. The electroacoustic transducer according to claim 4 further comprising supporting posts, situated on the bottom of the case, which are arranged to support the carrier.

6. The electroacoustic transducer according to claim 5 wherein corresponding ones of the supporting posts are vertically aligned with corresponding ones of the spacers.

7. The electroacoustic transducer according to claim 6 wherein the supporting posts are provided on the supporting portions of the carrier.

8. The electroacoustic transducer according to claim 5 wherein the supporting posts are provided on the carrier and are formed integrally with the carrier.

9. The electroacoustic transducer according to claim 8 wherein the supporting posts are provided on the supporting portions of the carrier.

10. The electroacoustic transducer according to claim 4 wherein the carrier has an annular shape and rests on a bottom of the case substantially throughout a circumference of the carrier.

11. The electroacoustic transducer according to claim 10 further comprising a sound inlet gate, wherein a space, in the case and located under the diaphragm enclosed by the carrier, communicates with the sound inlet gate via at least one passage in the carrier.

12. The electroacoustic transducer according to claim 11 wherein said one passage is formed by a substantially horizontally extending channel in the carrier.

13. The electroacoustic transducer according to claim 11 wherein the passage is formed by a combination of first and second slots formed in an undersurface and a top surface, respectively, of the carrier, the first slot terminating at an outer edge of the carrier and extending over a part of the width of the carrier, and the second slot extending only over a part of the width of the carrier and terminating at the inner edge of the carrier, wherein the first and second slots meet at a central portion of a body of the carrier.

14. An electroacoustic transducer comprising:

a substantially closed case provided with a sound inlet opening;

a microphone system, arranged in the case, which comprises:

a diaphragm clamped on a frame-shaped carrier, the diaphragm having at least partly provided with a conducting layer;

a backplate arranged adjacent and parallel to the diaphragm, the backplate being located on a side of the diaphragm remote from the carrier; and spacers arranged between the backplate and the diaphragm; and an amplifier circuit arranged in the case, the amplifier circuit having a differential amplifier, wherein first and second inputs to the differential amplifier are connected to the backplate and to the diaphragm, respectively, and both the diaphragm and the backplate are electrically floating with respect to the case.

15. The electroacoustic transducer according to claim 14 wherein the backplate is attached to the carrier.

16. The electroacoustic transducer according to claim 14 wherein the carrier is formed as an integral part of a bottom of the case.

17. A microphone system comprising:

a diaphragm clamped on a frame-shaped carrier and at least partly provided with a conducting layer;

a backplate arranged adjacent and parallel to the diaphragm, the backplate being located on a side of the diaphragm remote from the carrier and attached to the carrier by glue; and spacers arranged between the backplate and the diaphragm;

wherein the frame-shaped carrier is integrally provided with inwardly-extending supporting portions, oriented parallel to the diaphragm, which through an upper surface of the supporting portions solely supports the diaphragm, at least one of the supporting portions being located below and supporting one of said spacers, wherein the supporting portions support the diaphragm at corresponding locations of said spacers.

18. The microphone system according to claim 17 wherein the microphone system comprises an electret system, and an electret layer is provided on the backplate.

19. The microphone system according to claim 17 wherein at least three of said supporting portions are located below the spacers, and each one of the supporting portions supports a corresponding different one of the spacers.

20. The microphone system according to claim 19 wherein supporting posts are provided on the carrier such that corresponding ones of the support posts are vertically aligned with corresponding ones of the spacers.

21. The microphone system according to claim 20 wherein the supporting posts are provided on corresponding ones of the supporting portions of the carrier.

22. An electroacoustic transducer comprising:

a substantially closed case provided with a sound inlet opening;

a microphone system, arranged in the case, which comprises:

a diaphragm clamped on a frame-shaped carrier, the diaphragm being at least partly provided with a conducting layer;

a backplate arranged adjacent and parallel to the diaphragm, the backplate being located on a side of the diaphragm remote from the carrier; and spacers arranged between the backplate and the diaphragm; and an amplifier circuit arranged in the case;

wherein the frame-shaped carrier has supporting portions which support the diaphragm, at least one of the supporting portions being aligned with at least one of said spacers, and the amplifier circuit is provided with a differential amplifier, wherein first and second inputs of the differential amplifier are connected to the backplate and to the diaphragm, respectively, and both the diaphragm and the backplate are electrically floating with respect to the case.

23. The electroacoustic transducer according to claim 22 wherein the backplate is attached to the carrier by glue.

24. The electroacoustic transducer according to claim 22 wherein the carrier is formed as an integral part of a bottom of the case.

25. The electroacoustic transducer according to claim 22 wherein the microphone system comprises an electret system, and an electret layer is provided on the backplate.

26. The electroacoustic transducer according to claim 22 wherein at least three of said supporting portions are located below the spacer, and each one of the supporting portions supports a corresponding different one of the spacers.

27. The electroacoustic transducer according to claim 26 wherein supporting posts are provided on the carrier, the supporting posts being vertically aligned with said spacers.

28. The electroacoustic transducer according to claim 27 wherein said supporting posts are provided on said supporting portions of the carrier.

* * * * *